United States Patent [19]

Barberine et al.

[11] Patent Number: 4,643,016

[45] Date of Patent: Feb. 17, 1987

[54] SLAT BENDING TOOL

[76] Inventors: Frank G. Barberine; David D. Flora, both of c/o Arcancum Precision Products, P.O. Box 114, Arcanum, Ohio 45304-0114

[21] Appl. No.: 839,847

[22] Filed: Mar. 14, 1986

[51] Int. Cl.[4] ..... B21D 31/00

[52] U.S. Cl. ..... 72/387; 72/388; 72/465; 72/379; 72/459; 29/24.5

[58] Field of Search ..... 72/387, 388, 389, 465, 72/379, 458, 459, 479, 54, 418; 29/24.5

[56] References Cited

U.S. PATENT DOCUMENTS

| | | | |
|---|---|---|---|
| 296,177 | 4/1884 | Jones | 72/388 |
| 3,229,495 | 1/1966 | Tostenson | 72/418 |
| 3,258,948 | 7/1966 | Carlson, Sr. | 72/465 |
| 3,267,716 | 8/1966 | Hales | 72/384 |
| 3,400,568 | 9/1968 | Brandner | 72/388 |
| 3,583,199 | 6/1971 | Speiser | 72/387 |
| 3,613,427 | 10/1971 | Haddon | 72/212 |
| 3,914,972 | 10/1975 | Gillette et al. | 72/212 |
| 4,048,837 | 9/1977 | Spencer et al. | 72/387 |

FOREIGN PATENT DOCUMENTS

| | | | |
|---|---|---|---|
| 3318753 | 11/1984 | Fed. Rep. of Germany | 72/458 |

*Primary Examiner*—Lowell A. Larson
*Assistant Examiner*—David B. Jones
*Attorney, Agent, or Firm*—Biebel, French & Nauman

[57] ABSTRACT

A hand operated bending tool for forming a clean bend in a venetian blind slat includes a generally U-shaped upward-opening bottom member having a width which exceeds the width of the slat to be bent and having a length proportioned to receive one leg of a slat therein. The bottom member has a low friction curved portion leading into the interior of the member, permitting the slat to roll thereover during the bending operation. An elastomer portion in the bottom member, adjacent the forward end, defines a resilient slat-gripping surface to engage the slat legs and prevent sliding movement of the leg in the channel member during bending. A U-shaped, downwardly-opening top member is received within the bottom member, the top member having a remote end pivotally attached to the bottom member for movement between a raised position to a lowered position in which the upper top member is substantially nested within the bottom member. A slat leg therein is pressed against the gripping surface. A forward end of the top member is formed with transverse right-angled end surfaces positioned adjacent the low friction curved portion and the gripping surfaces respectively and defines forming surfaces for bending a slat. The top member defines a stop extending into the interior of the bottom member for engagement with the inner end of a slat leg inserted therein to define the position of the bend. The stop is mounted on the top member for adjusting movement longitudinally thereof.

11 Claims, 8 Drawing Figures

SLAT BENDING TOOL

BACKGROUND OF THE INVENTION

This invention relates to a hand tool for bending sheet metal material, and more particularly to a tool for forming right-angle bends in venetian blind slats.

In the installation of venetian blinds, particularly in the installation of narrow slat blinds, it is desirable to form a valance which covers the front and ends of the transverse operating box. Such valance commonly comprises two or more transverse non-moving venetian blind slats which extend along the length of the operating box and which are formed with right-angled bends at the ends, forming valance returns to enclose and cover the box ends. Straight sections of slats are commonly supplied by the manfacturer to permit the installer to form a bend at the desired depth, depending on the size of the operating box and the offset from the wall. Installers commonly attempt to bend such slat sections by hand or over the edge of a rule or table or the like, to approximate the depth or positon of the bend. Such hand made bends are at best only approximately made at the correct position, and are often less than straight or normal to the edges, thus giving an unprofessional or awkward appearance to the assembled valance. The installer's job is further complicated by the fact that so-called micro-slat blinds are coming onto the market with very narrow slats, such as only 0.60" wide or less. The manufacture on the installation site of attractive valances for these blinds is even more difficult where an attempt is made to form the bends by hand on the job site, in view of the size and relatively delicate nature of the material. Further, the aluminum material from which some slats are commonly made will break if an attempt is made to restraighten or bend the slat section a second time, to compensate for an error, with the resulting waste of material and delay. There accordingly exists a need for a hand tool which may accurately and repeatedly perform precise right-angled bends in venetian blind slats, for use by installers or the like in installing venetian blinds.

SUMMARY OF THE INVENTION

The invention is directed to an easy to use hand tool for bending strips of sheet metal material, and more particularly to such tool which is adapted to make precise right-angled bends in venetian blind slats.

The tool has upper and lower forming members which engage a slat section and accurately form a right-angle bend therein. As a preferred arrangement, the tool is formed generally from channel-shaped material and includes a lower channel member and an channel member pivotally mounted on the lower channel member. The sides of one of the channel members fit closely within the sides of the other channel member, and the opening between the sides is proportioned to receive one end of a venetian blind slat. The channel members are pivotally mounted together at one end, such as by a pivot pin or the like extending through the respective sides, to permit the members to be moved between an open slat-receiving position and a closed slat-forming position.

The lower forming member is provided with a curved entrance edge or the like, such as a low friction roller, which permits the material of the slat to be folded therepast during the closing movement, without marring. The upper member at its forward end, has substantially right-angled slat forming surfaces which join along a forming edge. The edge has a close fit with the low friction transverse edge of the bottom channel member when the tool is closed. A resilient pad or gripping surface in the lower channel member forms a cushion which engages a slab section at the forming end, which prevents slipping, and assures that the slat section is folded about the forming surfaces, when the members are moved to their closed position. Preferably, this is accomplished simply by holding the tool in one hand and pressing the top member by a thumb or the like down against the bottom member with a slat inserted therein.

The hand tool of this invention is further provided with means for accurately selecting the position of the bend in relation to one end of the slat. For this purpose, the tool is provided with an internal movable stop carried in the upper member. The stop is movable along an elongated slot formed in the upper member and may be clamped in any preselected adjusted position. The stop is preferably provided with two operative surfaces, one for engaging a conventional 1.0" slat, and another for engaging a micro-slat of 0.60" or less in width. The slot and the slat-engaging surfaces of the stop are so associated that the user can view the slat through the slot at the top to be sure that the slat is inserted properly. Further, a measuring scale is preferably formed in the top along the slot to aid the user in preselecting the exact position of the bend.

Since the material making up the venetian blind slats is usually metal such as aluminum and has a certain amount of spring-back after bending, it is preferable to provide the forming surfaces with an included angle which is slightly less than 90°, such as 82°, so that the slat is overbent by a small amount, such as 8° during the crimping and bending, to allow for spring-back.

It is accordingly an important object of this invention to provide a hand tool, as outlined above, by means of which an installer can readily perform precise and attractive bends in venetian blind slat material, for the on-site installation of a venetian blind valance.

A further object of the invention is the provision of a slat bending hand tool by means of which bends may be accurately positioned in such slat material at preselected positions along the length of the slat.

A further object of the invention is the provision of a slat bending tool which is of simplified constructions, easy to carry, and easy to use.

These and other objects and advantages of the invention will be apparent from the following description, the accompanying drawing and the appended claims.

DESCRIPTION OF THE PREFERRED EMBODIMENT

Figure 1:
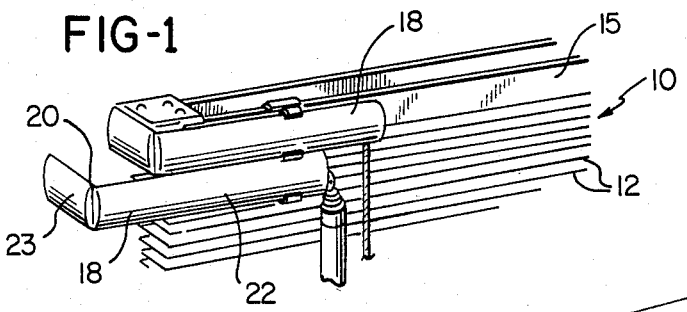
FIG. 1 is a fragmentary perspective view showing a valance for a venetian blind using the hand tool of this invention to form the right-angled bends in the blind slats.

Referring to the figures of the drawings which illustrate a preferred embodiment of the invention, and referring first to FIG. 1, a venetian blind is illustrated generally at 10 which is formed with a plurality of relatively narrow slats 12. The venetian blind has a conventional operating box 15 at the top, and a decorative valance employing individual slat sections 18, is carried on the box 15 for the purpose of providing a decorative finished appearance to the blind. The slat sections 18 are formed with a right-angled crease or bend 20 to define a front portion 22 of the slat section 18 and a rearwardly extending return portion 23. As can be seen in FIG. 1, the location of the bend 20 in relation to the return portion 23 must be accurately formed in the flat section 18 in order to provide an attractive appearance. The position of the bend 20 varies in accordance with the desired length of the right-angled return portions 23 of the slats 18 in order to provide the necessary coverage for the end of the valance. It is also desirable that each of the end portions 23 be of precisely the same length to have the appearance of a professional installation. Forming such bends by hand is both tedious, wasteful of material, and further frequently results in a less than professional appearance for the valance.

Figure 2:
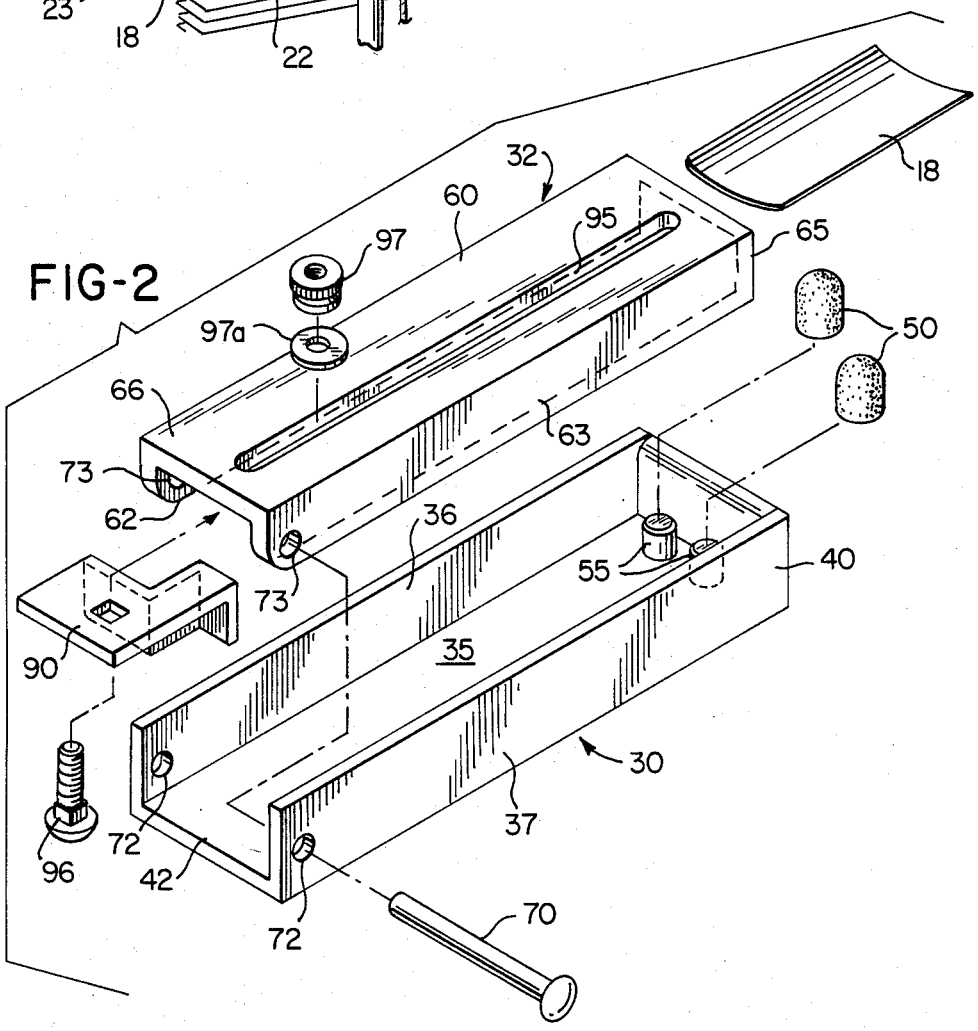
FIG. 2 is an exploded view of the slat-bending hand tool of this invention.
Figure 3:
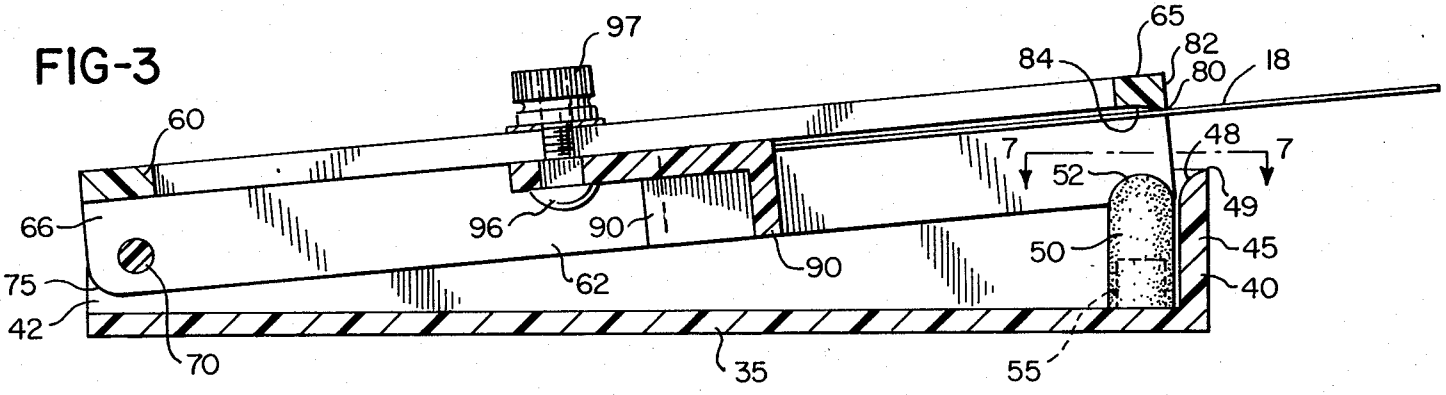
FIG. 3 is a longitudinal section through the tool showing a blind slat section inserted therein for crimping or bending.

The hand-operated bending tool of this invention is illustrated in exploded view in FIG. 2 and in longitudinal section in FIG. 3 as including a generally U-shaped upwardly opening bottom channel member 30 and a cooperating generally U-shaped downwardly opening upper or top member 32. The bottom member 30 is formed with a transverse longitudinally extending bottom 35 and a pair of upstanding spaced-apart sides 36 and 37. The spacing between the sides 36 and 37 is sufficient to receive the upper or top member 32 therebetween and to receive a section of a slat 18 therebetween for crimping or bending.

Figure 5:
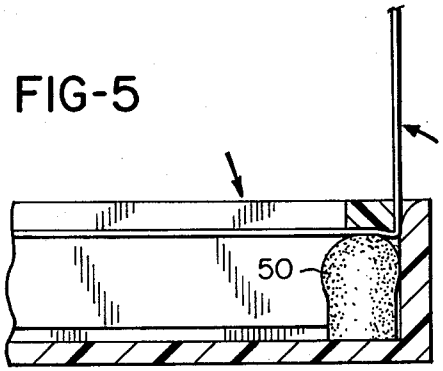
FIG. 5 is a view similar to FIG. 4 showing the completion of the crimp or bend in a venetian blind slat.
Figure 4:
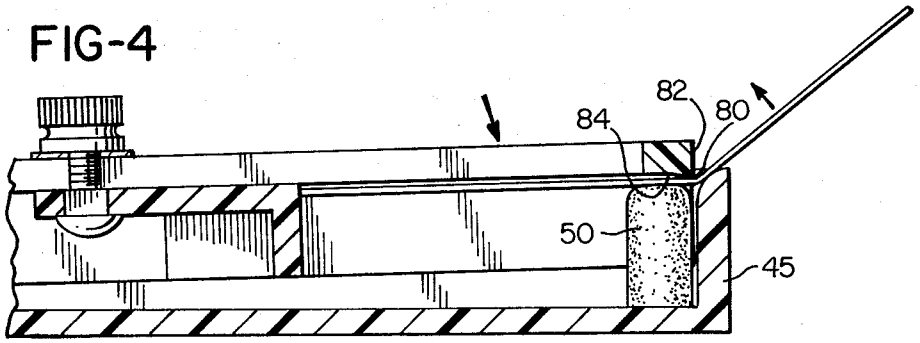
FIG. 4 is a fragmentary section similar to FIG. 3 showing the beginning of the formation of a crimp or bend using the hand tool.

The bottom member 30 is formed with a forward end 40 and a remote end 42. Means at the forward end defining a low friction non-marring slat-engaging surface is formed by a forward transverse wall 45 as best shown in FIG. 3. The wall 45 extends between the sides 36 and 37 and is formed with an upper curved surface 48 extending from a front lip 49 smoothly inwardly to permit the slat section 18 to slide thereby during the bending step, as shown in FIGS. 4 and 5. While it is preferred to form the surface 48 as a low friction curved portion leading into the interior of the bottom member 30, it will be understood that other means may be provided, such as a transverse roller, at this location.

The bottom member 30 at the forward end 40 also supports or contains resilient cushion means on the bottom 35 and between the upstanding sides 36 and 37. This cushion means consists of one or more blocks 50 of an elastomer positioned immediately inwardly of the wall 45 and immediately adjacent the surface 48. The elastomer block or blocks 50 provide an upper resilient impact surface 52 which, in the relaxed position, is elevated substantially to the same elevation as that of the curvature 48, to engage the outer surface of the slat section 18 during the forming and bending step. The resilient surface 52 is also preferably a relatively high friction surface which prevents the sliding of the slat section and assures the smooth bending of the section during the bending step and assures the maintenance of the slat section with the forming edges on the top member 32, described below.

Preferably, the elastomer blocks 50 may consist of molded vinyl footings or rod end bumpers which are partially hollow and may be frictionally mounted over a pair of short upstanding studs 55 formed or molded in the bottom 35 adjacent the front wall 45. Alternatively, a single block of elastomer material, such as a vinyl or rubber composition, may be bonded at this location to provide the desired upper resilient impact surface 52.

The upper channel-shaped member 32 forms the top of the tool, and is formed with a longitudinally extending top 60 and a pair of depending sides 62 and 63. The sides 62 and 63 are proportioned to nest closely within the corresponding sides 36 and 37 of the lower member.

The top member 32 is also formed with the forward forming end 65 and a remote end 66. Means pivotally connecting the respective remote ends 35 and 66 together, include a transverse pin 70 which may extend through suitable openings 72 formed in the sides 36 and 37 and correspondingly aligned opening 73 formed in the sides 62 and 63, at the respective remote ends. The rearward portions of the depending sides 62 and 63 may be slightly curved at 75, as best shown in FIG. 3, to prevent interference between the sides and the bottom of the adjoining member during opening and closing movement. The top member 32 is thus pivotally attached to the bottom member 30 for movement between a raised slat-receiving position as shown in FIG. 3 and a lowered position substantially as shown in FIGS. 4 and 5, in which the top member is substantially nested within the bottom member, in a slat-bending step.

The forward forming end of the top member 32 is formed with a generally right-angled transversely extending edge 80 defined by a transverse front surface 82 and a bottom forming surface 84 which surfaces join along a relatively sharp and cleanly formed edge 80. The forward surface 82, and the closed position as shown in FIG. 5, is immediately adjacent the forward curved edge 48, but slightly spaced therefrom to accommodate the thickness of a slat section therebetween. The bottom surface 84 is immediately superimposed over the resilient block 50 and in fact, in the fully closed position as shown in FIG. 5 causes the blocks 50 to be compressed slightly by the slat section 18, thereby causing the material of the slat section 18 to be held firmly against the surface 84 and about the edge 80. Preferably, the included angle formed by the surfaces 82 and 84 is somewhat less than 90°, such as 82°, for example, to provide a slight overbending of the slat section to provide or allow for spring back of the material of the slat section when it is removed from the bending tool.

Figure 6:
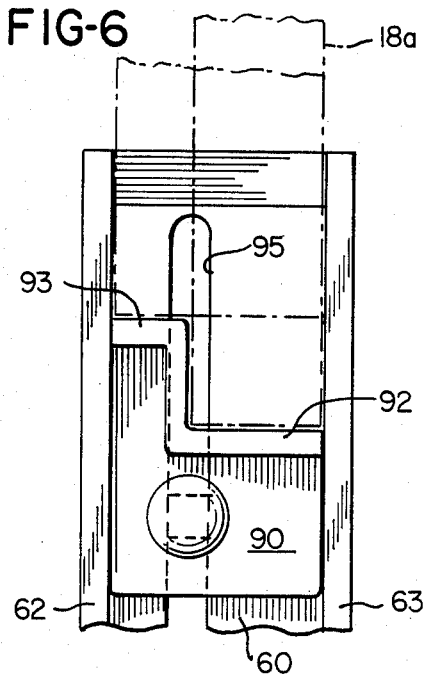
FIG. 6 is an enlarged fragmentary view looking inside the top channel member and showing the adjustable stop and the relationship of such stop with narrow and conventional blind slats.
Figure 7:
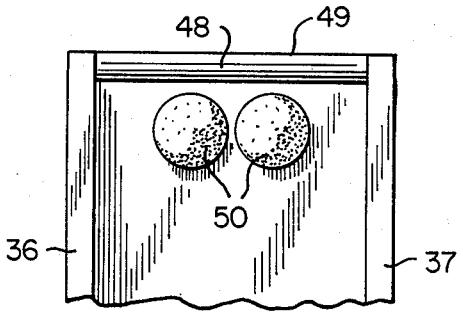
FIG. 7 is a fragmentary view looking into the interior of the bottom channel section showing the elastomer or resilient supports and the curved front bending edge.

The invention further includes means in the top member 32 defining a stop which extends into the interior of the bottom member 30 for engagement with the inner end of a slat section or one leg thereof which is inserted within the tool, to define the exact position of the bend. The stop may be a sliding insert member 90 which is formed with one or more forward slat engaging surfaces 92 and 93, as best shown in FIG. 6. The stop 90 is proportioned to form a relatively close sliding fit between the side walls 62 and 63 and is accordingly easily movable longitudinally of the upper or top member 32. The stop 90 is slidable within a longitudinally extending slot 95 formed in the top member 32 and retained by a threaded post 96, a washer 97*a*, and a nut 97 in any selected position along the slot 95. The forward slat-engaging surfaces 92 and 93, as illustrated in FIG. 6, provide for selective engagement of two different widths of slats. The now rather conventional 1" slat, illustrated by the slat 18, would come into engagement with the forwardmost surface 93 and would be viewable through the slot 95 to assure that it is inserted to the proper depth. Micro mini-blinds are now being made with substantially narrower slats, such as illustrated by the slat 18*a* of FIG. 6 and the recessed surface 92 is provided to receive such a narrow slat 18*a* for precise location of the same within the tool. It will be noted that the edge of the narrow slat 18*a* is also viewable from the top through the slot 95.

Figure 8:
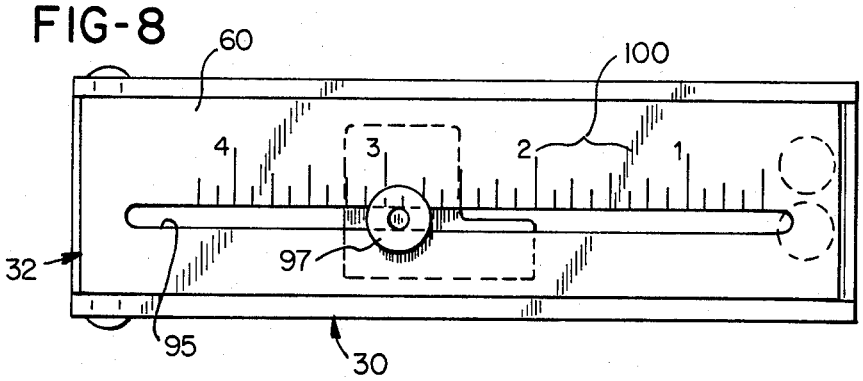
FIG. 8 is a plan view of the crimping tool showing the adjustable stop and the measuring scale.

The tool further includes means in the top 32 forming a measuring scale which extends along one edge of the slot 95, as illustrated by the scale 100 of FIG. 8. The scale may be conveniently marked in inches or other measurements to permit an observation, by the user, of the depth of insertion of either a slat 18 or 18*a*, as viewed through the slot 95.

The operation of the hand tool of this invention is believed to be largely self-evident from the foregoing description. A section of slat 18 to be crimped or bent into the shape as illustrated in FIG. 1 is inserted into the space between the side walls 62 and 63 of the upper channel member 32 and brought against the appropriate surface of the stop 90, with the concave side of the section facing upwardly, which will ultimately be the inside and non-viewed section of the completed valance return. The depth of insertion as defined by the stop will correspond to the length of the end portion 23 of the completed valance, and may be conveniently selected by moving the stop 90 along the top in the slot 95 by loosening the nut 97 and retightening at the appropriate location, while viewing the slat through the slot 95, in relation to the scale 100. Thereafter, the stop 90 may be tightened in position and the tool used repeatedly to make valance sections which are identical to each other.

The bottom member 30 may be held in the hand while the top 32 is pressed downwardly by the thumb to cause the members to move from the open position as shown in FIG. 3 to the initial forming or closed position shown in FIG. 4, in which the curved low friction and non-marring surface 48 begins to cause the slat 18 to be folded over the forming edge 80 and against the forward forming surface 82, as shown in FIG. 5. The surface 52, defined by the blocks 50 of elastomer, engage the outer surface of the slat and are slightly compressed as the top is moved to the complete forming position as shown in FIG. 5 and assures full contact of the portion 23 of the slat within the bending tool about the edge 80 and against the bottom-forming surface 84. As previously noted, there is a sufficient clearance between the edge 82 and the curved forward surface 48 to permit the material of the slat to be folded thereover as shown in FIG. 5 without binding. When the top member 32 is released, as aided by the restoring forces of the elastomers 50, the now bent slat section may be removed. Repeated slat sections may be bent as described above with complete accuracy and with ease. Since the included angle defined by the joining surfaces 82 and 84 about the forming edge 80 is slightly less than 90°, a correspondingly slight overbend is formed in the slat section to accommodate the expected spring back of material following bending. The depth of insertion of either the 1" style slat 18 or the micro mini-blind width slat 18*a*, in either case, is directly viewable in relation to the stop 90 through the slot 95 before and during bending.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A hand operated bending tool for forming a clean bend in a venetian blind slat to form a right-angled leg portion of the slat of a precise length, comprising:

a generally U-shaped upward-opening bottom member having a width which exceeds the width of the slat to be bent and having a length proportioned to receive one leg of a slat therein, said bottom member having means at a forward end thereof defining a low friction curved portion leading into the interior of said member, permitting said slat to roll thereover during the bending operation, elastomer means in said bottom member, adjacent said forward end, defining a resilient slat-gripping surface proportional to engage said slat legs and prevent sliding movement of the said leg in said channel member during bending, an U-shaped, downwardly-opening top member adapted to be received within said bottom member, said top member having a remote end thereof pivotally attached to said bottom member for movement between a raised position to a lowered position in which said upper top member is substantially nested within said bottom member, and a slat leg therein is pressed against said gripping surface, a forward end of said top member being formed with transverse substantially right-angled end surfaces positioned closely adjacent said low friction curved portion and said gripping surfaces respectively and defining forming surfaces for bending a slat, and means on said top member defining a stop extending into the interior of said bottom member for engagement with the inner end of a slat leg inserted therein to define the position of the bend, and means mounting said stop on said top member for adjusting movement longitudinally thereof.

2. The tool of claim 1 in which said adjustable stop further has means defining a first stop surface for use with slats of a first width and a second stop surface for use with slats of a width narrower than said first width, and means in top member defining a longitudinally extending slot through which such slots may be observed in abutting relation to said stop surfaces.

3. The tool of claim 1 in which the angle formed by said end surfaces on said top member is slightly less than 90° so that slats formed thereover will have a substantially 90° bend following spring back of the material after forming.

4. A hand tool for crimping sections of venetian blind slat material to form a right angle bend such as for a valance or the like, comprising:

a lower channel member having a bottom and upstanding spaced sides, a working end and a remote end, said sides spaced to permit the easy reception of a venetian blind slat therebetween, means associated with said working end thereof defining a low friction non-marring transverse surface portion extending between said sides to permit the folding movement of a slat therepast without marking said slat, means immediately inward of said transverse surface portion defining a resilient surface for engaging and gripping such slat during forming, an upper channel member having a top, and having downwardly extending sides proportioned to be received between said lower channel member sides, said upper channel member having a remote end and a forming end, means pivotally connecting said remote end at the downwardly extending sides thereof to the remote end of said lower channel member at the upstanding sides thereof providing for movement of said channel members between an open slat-receiving position and a closed slat-bending position, said upper channel member at said forming end thereof having in said top transverse metal-forming surfaces joined along a generally right-angled edge which edge in said closed positon is immediately adjacent said lower channel transverse surface portion and in immediately superimposed relation to said resilient surface, whereby a venetian blind slat inserted between said members in said open positon is transversely folded about said edge and along said forming surfaces by moving said channel members to said closed position.

5. The tool of claim 4 further comprising means in which said upper channel member defining a longitudinally-extending slot, a slat-engaging stop member received in said upper channel member between said sides thereof, means slidably mounting said stop member for longitudinal movement in said upper channel member along said slot to define the extent of insertion of a slat therein, said inserted slat being viewable through said slot.

6. The tool of claim 5 in which said stop mounting means comprises a threaded member extending through said slot, and means on said threaded member for clamping said stop member in pre-selected positions along said slot.

7. The tool of claim 6 further comprising means in said upper channel member's top forming a measuring scale extending along said slot by which the depth of insertion of a slat can be set by a corresponding adjustment of said stop member.

8. The tool of claim 4 in which said forming surfaces form with an included angle which is slightly less than 90° to allow for spring-back of a slat after bending.

9. A hand tool for crimping sections of venetian blind slat material to form a right angle bend such as for a valance or the like, comprising:

a lower member having a working end and a remote end, means associated with said working end thereof defining a low friction non-marring transverse surface portion to permit the folding movement of a slat therepast without marking said slat, means immediately inward of said transverse surface portion defining a high-friction resilient surface for engaging and gripping such slat during forming, an upper member having a remote end and a forming end, means pivotally connecting said upper member to said lower member providing for movement of said members between an open slat-receiving position and a closed slat-bending position, said upper member at said forming end thereof having in said top transverse metal-forming surfaces joined along a generally right-angled edge which edge in said closed position is immediately adjacent said lower transverse surface portion and in immediately superimposed relation to said resilient surface, whereby a venetian blind slat partially inserted into said channel members between the sides thereof in said open position is transversely folded about said edge and along said forming surfaces by moving said members to said closed position.

10. A hand tool for bending sections of venetian blind slat material to form right-angle portions, such as in the installation of a valance or the like, comprising:

a lower elongated forming member having a bottom and upstanding sides, a working end and a remote end, said lower member having a width between said sides to permit the easy reception of a venetian blind secton therein, means on said working end thereof defining a raised low-friction, non-marring transverse surface portion extending between said sides to permit the movement of a section of a slat therepast without marking said slat section, cushion means on said bottom between said sides immediately inward of said transverse surface portion defining a resilient impact surface for supporting said slat section during forming, an upper elongated forming member having a top and spaced sides proportioned to be received within the sides of said lower forming member, said upper member having a remote end and a forming end, means pivotally forming members at the respective said remote ends thereof providing for movement of said members between an open slat-receiving position and a closed slat-bending position, said upper member at said forming end thereof having slat bending means in the form of a generally right-angled transversely extending edge which in said closed position is adjacent to and inward of said lower member transverse surface portion and in superimposed relation to said cushion means, whereby a venetian blind slat section having an end inserted in said members between the respective sides thereof in said open position is caused to be folded about said edge when said members are moved to said closed position.

11. The tool of claim 10 further comprising means in said upper member defining a longitudinally-extending slot in said top thereof, a slat-engaging stop received in said upper member between the sides thereof, means slidably mounting said stop for longitudinal movement in said upper member along said slot to define the extent of insertion of a slat section, said inserted slat section being viewable through said slot.

* * * * *